US006227550B1

(12) United States Patent
Maggiolo

(10) Patent No.: US 6,227,550 B1
(45) Date of Patent: May 8, 2001

(54) SKATES WITH IN-LINE WHEELS HAVING IMPROVED MANEUVERABILITY AND CONTROL

(76) Inventor: Marco Maggiolo, Via Saccardo, 11, 30030 Chirignago (IT)

( * ) Notice: Subject to any disclaimer, the term of this patent is extended or adjusted under 35 U.S.C. 154(b) by 0 days.

(21) Appl. No.: 09/308,493

(22) PCT Filed: Dec. 1, 1997

(86) PCT No.: PCT/EP97/06706

§ 371 Date: May 20, 1999

§ 102(e) Date: May 20, 1999

(87) PCT Pub. No.: WO98/24525

PCT Pub. Date: Jun. 11, 1998

(30) Foreign Application Priority Data

Dec. 3, 1996 (IT) ..... PD96A0296

(51) Int. Cl.[7] ..... A63C 17/06

(52) U.S. Cl. ..... 280/11.223; 280/11.221; 280/11.222; 280/11.224; 280/11.225; 280/11.231; 280/11.232

(58) Field of Search ..... 280/11.22, 11.204, 280/11.207, 11.208, 11.211, 11.214, 11.215, 11.216, 11.221, 11.231, 11.223, 11.27, 11.28, 11.36, 11.225, 11.224, 843

(56) References Cited

U.S. PATENT DOCUMENTS

| | | | | |
|---|---|---|---|---|
| 477,550 | * | 6/1892 | Kenney | 280/11.36 |
| 926,646 | * | 6/1909 | Eubank, Jr. | 280/11.36 |
| 5,135,244 | * | 8/1992 | Allison | 280/11.28 |
| 5,342,071 | * | 8/1994 | Soo | 280/11.22 |
| 5,405,156 | * | 4/1995 | Gonella | 280/11.28 |
| 5,522,621 | * | 6/1996 | Schneider | 280/825 |
| 5,586,777 | | 12/1996 | Wolf | 280/11.22 |
| 5,690,344 | * | 11/1997 | Chen | 280/11.28 |
| 5,791,665 | * | 8/1998 | Mayer, II | 280/11.22 |
| 5,823,543 | * | 10/1998 | Burns et al. | 280/11.22 |
| 5,855,380 | * | 1/1999 | Di Filippo et al. | 280/7.13 |
| 5,873,583 | * | 2/1999 | Moore | 280/11.21 |
| 5,908,196 | * | 6/1999 | Weiss | 280/11.19 |
| 5,927,728 | * | 7/1999 | Gignoux et al. | 280/11.2 |
| 5,947,487 | * | 9/1999 | Keleny et al. | 280/11.22 |
| 5,957,470 | * | 9/1999 | Powell | 280/11.22 |
| 6,029,983 | * | 2/2000 | Wegener | 280/11.22 |

FOREIGN PATENT DOCUMENTS

| | | |
|---|---|---|
| 2744373 | 8/1997 | (FR) . |
| 9210251 | 6/1992 | (WO) . |
| 9312846 | 7/1993 | (WO) . |

* cited by examiner

*Primary Examiner*—Eric Culbreth
*Assistant Examiner*—J. Allen Shriver
(74) *Attorney, Agent, or Firm*—Guido Modiano; Albert Josif; Daniel O'Byrne

(57) ABSTRACT

Skates with in-line wheels, each comprising a supporting structure to which supports are connected for a plurality of wheels, wherein at least one of the central wheels is coupled to the supporting structure so that it can change the level of its rotation axis.

20 Claims, 3 Drawing Sheets

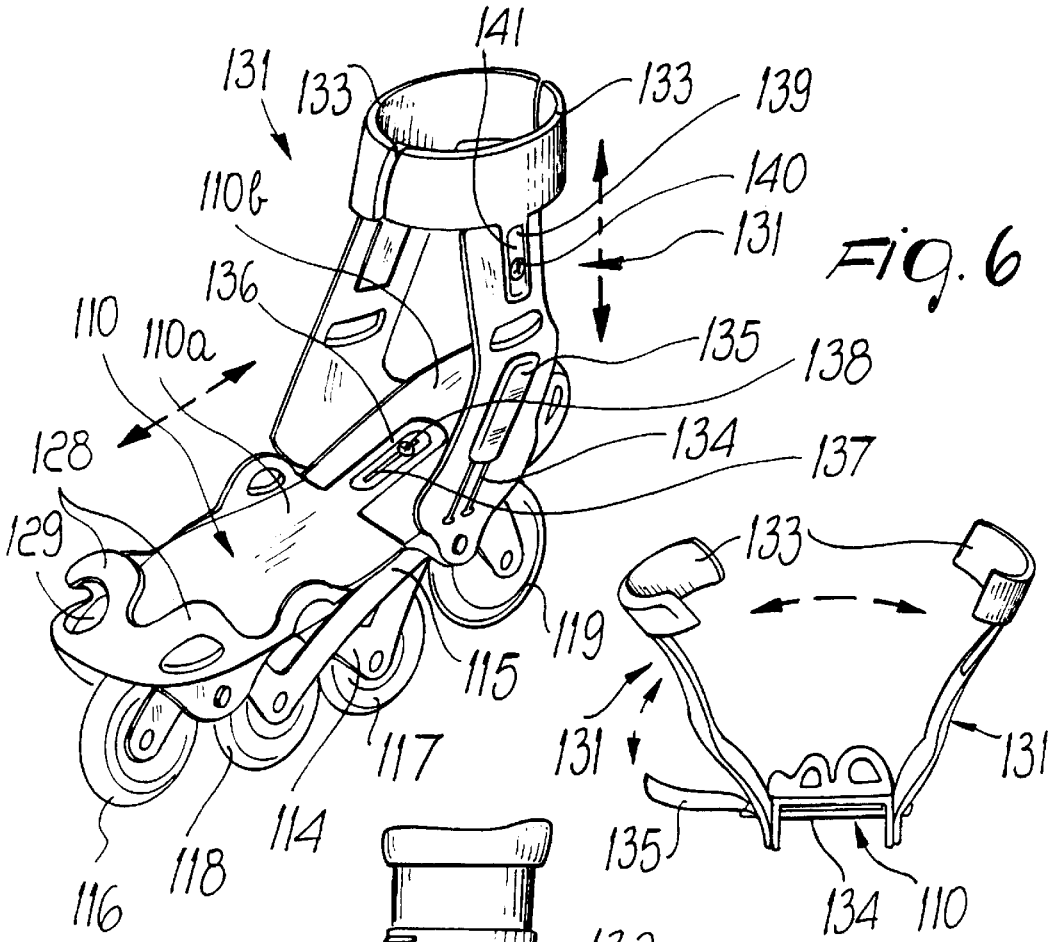
Fig. 6
Fig. 8
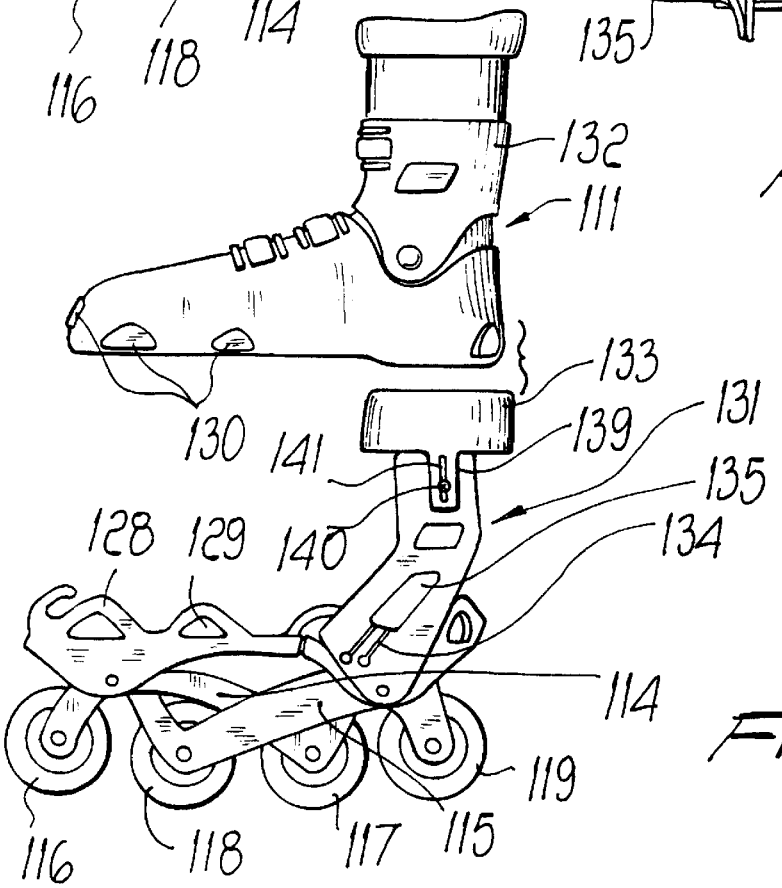
Fig. 7

SKATES WITH IN-LINE WHEELS HAVING IMPROVED MANEUVERABILITY AND CONTROL

TECHNICAL FIELD

The present invention relates to skates with in-line wheels.

BACKGROUND ART

It is known that roller skates known as in-line skates have become very popular in recent years.

Their increasing demand has been so significant that conventional roller skates with two pairs of twin wheels have practically disappeared.

The success of skates with in-line wheels is such that all sports gear manufacturers are currently ready to market their own range of in-line skates.

These in-line skates substantially have a supporting structure which is rigidly coupled to a shoe in an upward region; the shoe is generally of the type with a rigid shell made of plastics with a soft innerboot, and supports are rigidly fixed to the structure in a downward region; generally four but rarely even three or six wheels arranged in front of each other are articulated to the supports.

The wheels, which have the same diameter and thickness, have a diametrical cross-section which is rounded at its ends, so that the rolling band is particularly narrow.

The ground contact area of each wheel is also particularly narrow and depends on factors such as the type of material (generally a polymer), the weight of the user and the degree of wear.

The technique for using these skates is different from that of twin-wheel skates and is more similar to that of ice skates which, as is known, have a rather long rigid metal blade rigidly coupled edgeways below the shoe.

In skates with in-line wheels, the overall longitudinal dimensions of the wheels even exceed the length of the shoe; while this fact, on the one hand, facilitates travel in a straight line and increases their stability, it entails difficulties in handling turns, which are performed by tilting the entire implement and by changing the direction of each step with respect to the preceding one.

The rigid coupling of the rotation axes of the wheels to the supports also causes every roughness of the ground to be transmitted through the implement to the athlete's leg; this of course worsens control of the implement in addition to having a negative effect on the athlete.

WO93/12846 discloses skates with in-line wheels as defined in the preamble of claim 1.

DISCLOSURE OF THE INVENTION

The aim of the present invention is to provide skates with in-line wheels for which turning and maneuverability in general are easier.

Within the scope of this aim, a consequent primary object of the present invention is to provide skates with in-line wheels for which stability during straight-line travel is at least equal to that of current skates.

Another important object of the present invention is to provide skates with in-line wheels which are capable of absorbing the stresses induced in a substantially vertical direction by uneven ground.

Another important object of the present invention is to provide skates with in-line wheels which provide faster skating.

Another important object of the present invention is to provide skates with in-line wheels which have improved efficiency and are more controllable with respect to current skates.

Another object of the present invention is to provide skates with in-line wheels which can be manufactured with conventional equipment and systems.

This aim, these objects and others which will become apparent hereinafter are achieved by skates with in-line wheels, each comprising a supporting structure to which supports are connected for a plurality of wheels, characterized in that at least one of the central wheels is coupled to the supporting structure so that it can change the level of its rotation axis.

Advantageously, each one of the skates comprises at least two supports which are coupled to the supporting structure that is coupled to the shoe in an upward region; each one of said supports bears a pair of wheels, and said supports are arranged so as to alternate the wheels of one support with the wheels of the other; the coupling of at least one of said supports to said supporting structure is such as to allow to change the level of at least one of the respective rotation axes of the wheels.

BRIEF DESCRIPTION OF THE DRAWINGS

Further characteristics and advantages of the present invention will become apparent from the following detailed description of two possible embodiments thereof, illustrated only by way of non-limitative example in the accompanying drawings, wherein:

FIG. 6 is a perspective view of a second embodiment of the in-line skates, with a shoe which can be disconnected from the actual skate;

FIG. 7 is a side view of the second embodiment, in which the accompanying shoe is also shown;

FIG. 8 is a front view of the skate of FIGS. 6 and 7, with the wheel and the shoe removed.

WAYS OF CARRYING OUT THE INVENTION

Figure 1:
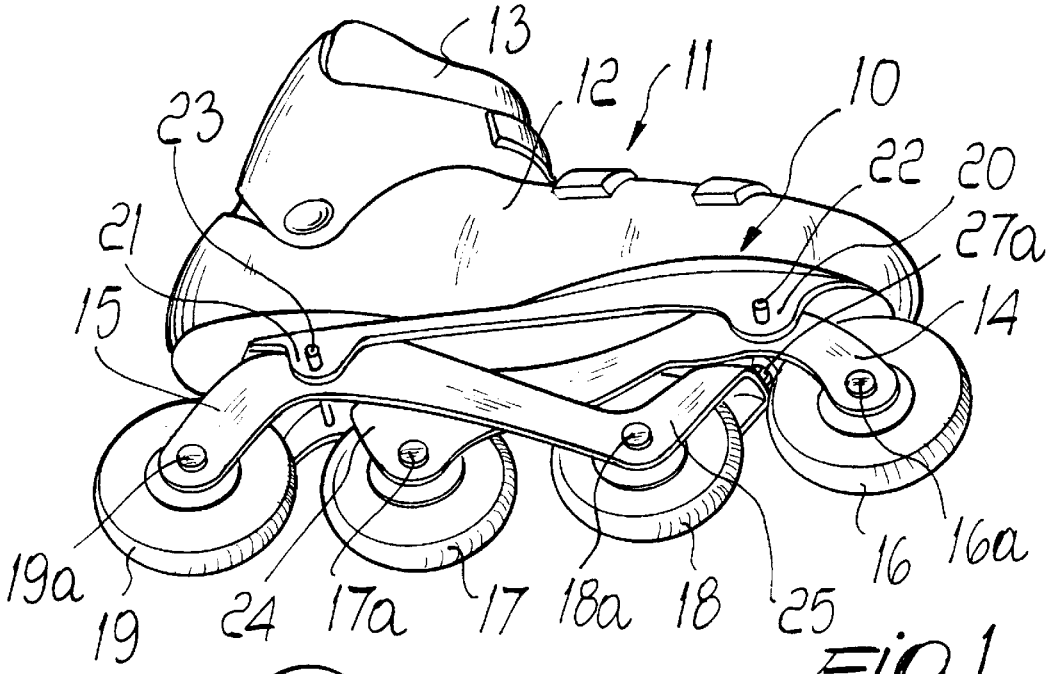
FIG. 1 is a perspective view, taken from below, of a first embodiment of the skates with in-line wheels, according to the present invention, with the shoe rigidly coupled to the supports of the wheels.

With reference to FIGS. 1 to 5, in a first embodiment a skate with in-line wheels according to the present invention comprises a supporting plate 10 which is rigidly coupled, in an upward region, to a shoe 11, which in this case is constituted by a plastic shell 12 with a soft inner boot 13.

Two supports, respectively 14 and 15, are coupled to the plate 10; each support bears a pair of wheels, respectively the wheels designated by the reference numerals 16 and 17 with respective axles 16*a* and 17*a* for the support 14 and the wheels designated by the reference numerals 18 and 19 with respective axles 18*a* and 19*a* for the support 15.

The two supports 14 and 15 are arranged so as to mutually intersect, so that the wheels of one support are alternated with the wheels of the other; in particular, from the front part toward the rear part the sequence of the wheels is 16, 18, 17, 19.

The two supports 14 and 15 are configured so as to have a transverse profile shaped like an inverted U, so as to form the supporting shoulders for the wheel axles, and each support has a cradle-like shape between the two axles.

In front and rear positions with respect to the shoe 11, the plate 10 has pairs of lateral tabs, respectively 20 and 21, to which the cradle-shaped portions of the supports 14 and 15 are hinged at respective axes 22 and 23.

The two supports 14 and 15 are provided with extensions, respectively 24 and 25, which protrude from the axles 17*a* and 18*a* and are fixed to the plate 10 with respective elastomeric pads 26 and 27 interposed therebetween.

In combination with the above, or as an alternative thereto, it is possible to drive screws, respectively designated by the reference numerals 26*a* and 27*a*, in suitable holes of the plate 10; the screws constitute adjustable-stroke limiters for the movements of the supports 14 and 15.

The pads for coupling to the plate 10 may also be replaced for example with an elastic element, such as a spring, optionally having an adjustable elastic response, which mutually connects the two supports 14 and 15.

Furthermore, the two supports 14 and 15 rest laterally on Teflon elements 14*a* and 15*a* which are fixed to the plate 10 and act as guides for them.

Figure 2:
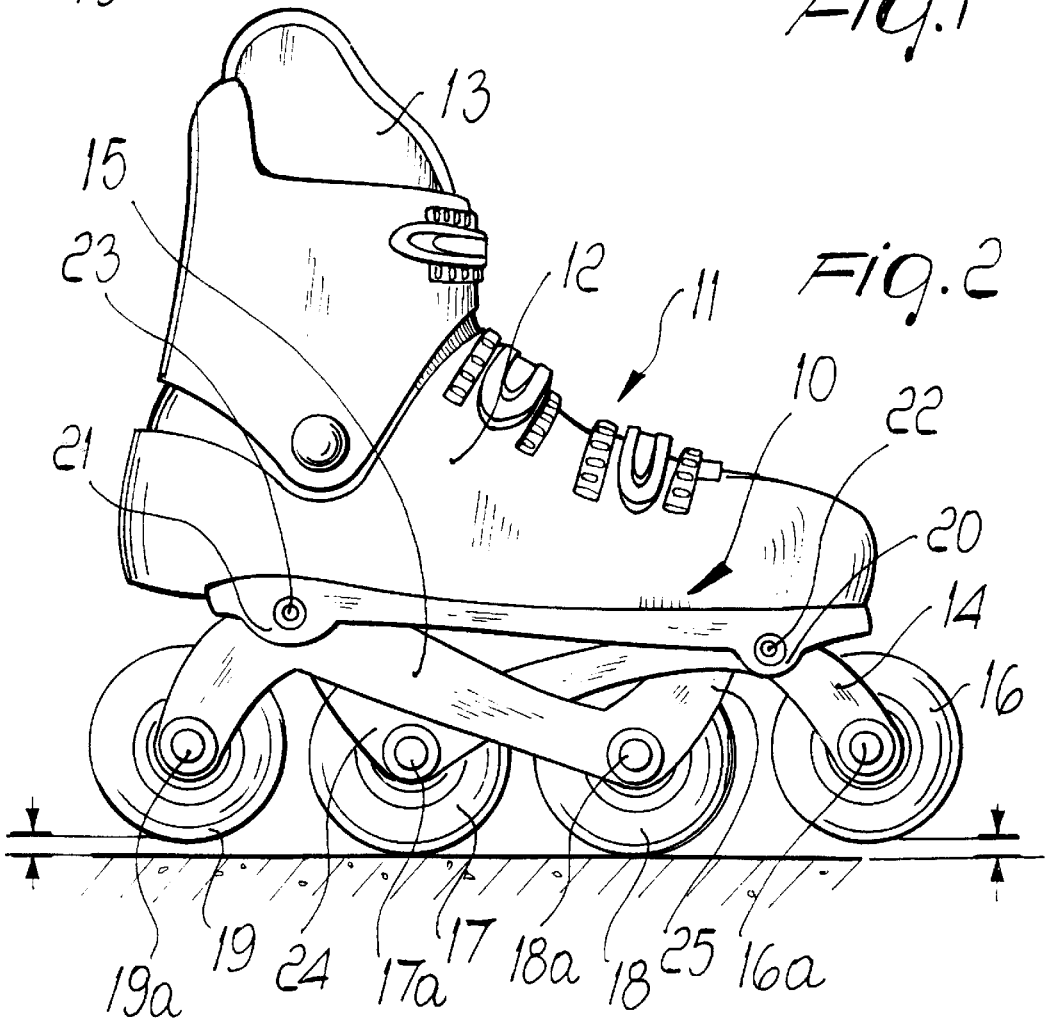
FIG. 2 is a side view of the skate of FIG. 1.
Figure 3:
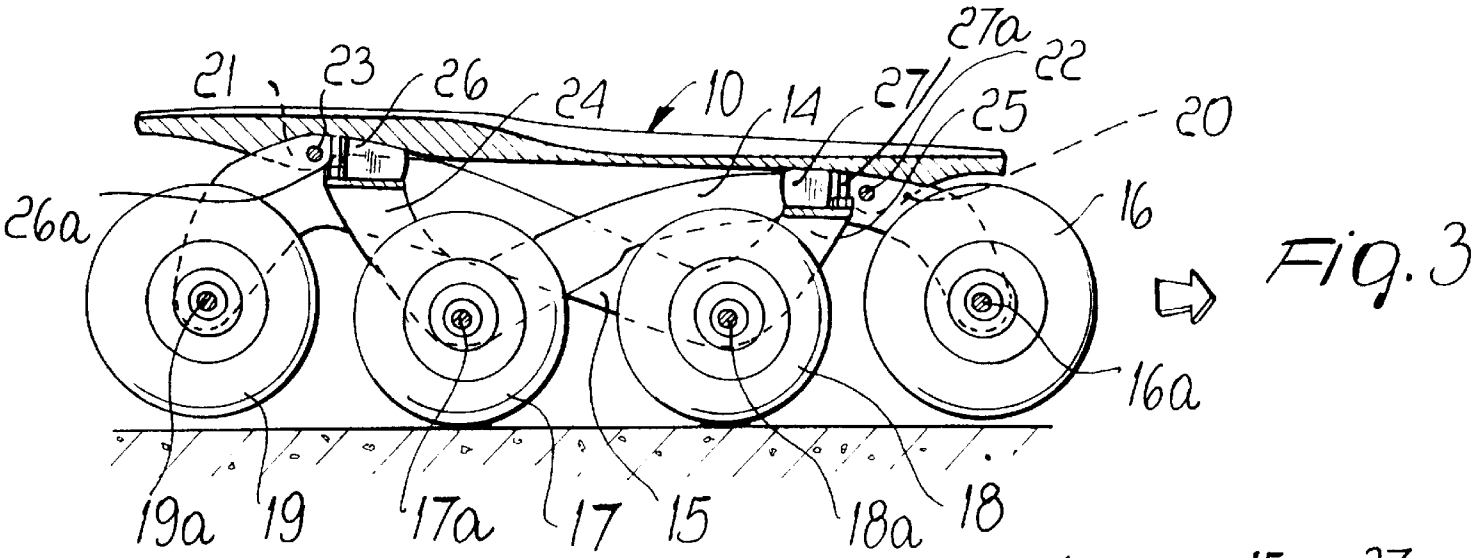
FIG. 3 is a partially sectional side view of the part of the skates of FIGS. 1 and 2 arranged below the shoe.
Figure 4:
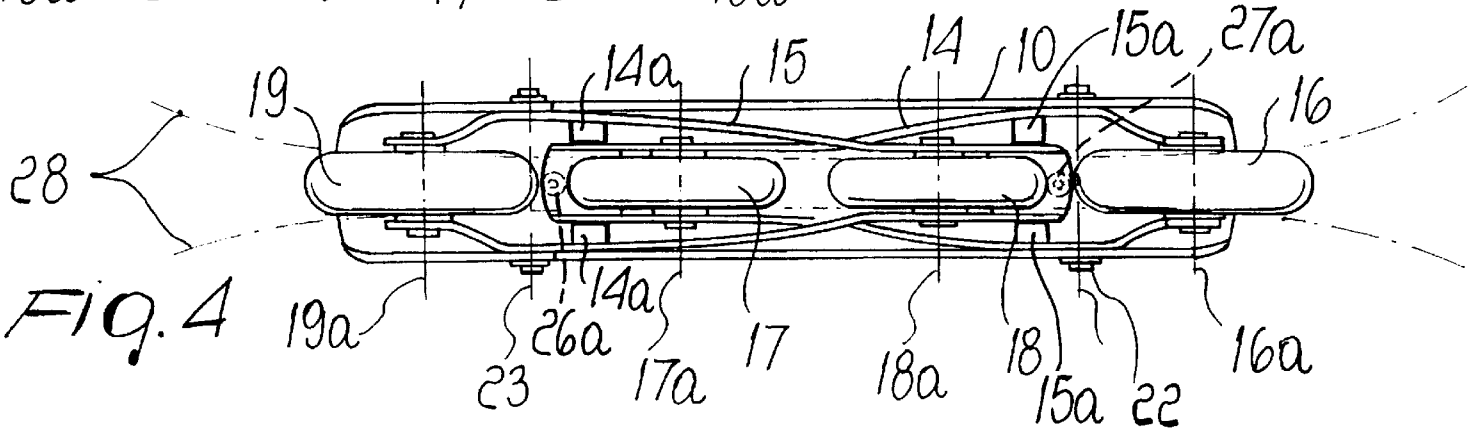
FIG. 4 is a bottom view of the part of the skate shown in FIG. 3.
Figure 5:
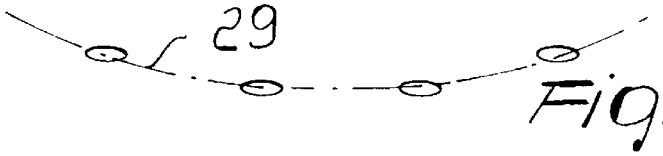
FIG. 5 is a diagram of the arrangement of the ground contact regions during turns.

As clearly shown in particular in FIG. 2, the arrangement of the wheels of the respective rotation axes is such that the end wheels 16 and 19, when no weight bears thereon, do not touch the ground, whereas due to the weight of the body the pads 26 and 27 are compressed and the supports 14 and 15 rotate about the axes 22 and 23, so that all the wheels rest on the ground.

It should also be noted that the two central wheels 17 and 18 are narrower and/or different in profile with respect to the wheels 16 and 19, so that the ground contact areas are wider at the ends than at the center.

Accordingly, if two imaginary lines are traced which are tangent to the wheels (designated by the reference numeral 28 in FIG. 4), two curves are obtained which can be compared to the sidecut lines of skis.

It should also be noted that the central wheels 17 and 18 have a smaller diameter than the end wheels 16 and 19.

Accordingly, when the skate is tilted with respect to the vertical and is subjected to a load, also because of the reduced thickness, the level of the central wheels 17 and 18 varies with respect to the other wheels and to the plate 10, so that they touch the ground with contact areas which are not aligned (see outline 29 of FIG. 5) with respect to the other two wheels, further increasing the sidecut effect.

The skate therefore no longer tends to follow a straight path but turns and follows the arc that joins the four contact areas.

This naturally allows improved maneuverability and steerability of the skate which, while maintaining the same stability during straight-line skating achieves higher turning speeds since it is possible to make tighter curves.

It should also be noted that the ability of the wheels to perform elastic oscillations because of the presence of the pads 26 and 27 at least partially cushions the stresses induced by ground roughness, which would otherwise affect the athlete's legs directly.

With particular reference now to FIGS. 6 to 8, the skates according to the present invention, in a second embodiment, have a supporting plate 110 to which a shoe 111 can be coupled and uncoupled, as described in greater detail hereinafter, and below which supports 114 and 115 are coupled which are equivalent to the preceding ones 14 and 15 and are provided, like them, with wheels designated by the reference numerals 116, 117, 118 and 119 respectively.

The plate 110 is configured in an upward region so as to form tabs 128 with hollows 129 in which corresponding tabs 130 fit; said tabs 130 protrude at corresponding positions of the upper of the shoe 111.

In other embodiments, the coupling can of course also be inverted, providing tabs on the plate and hollows in the shoe.

As shown in FIG. 8, two openable wings 131 are also articulated to the plate 110 in a rearward position and enclose the quarter 132 of the shoe 111 with two end half-rings 133 which are preferably padded.

The opening of the wings 131 is caused by their rotation about the respective longitudinal axes, which are horizontal with respect to the plate 110.

Closure is achieved by means of a cable device 134 actuated by a lever 135 which is joined laterally to one of the wings 131.

The wings 131 also have locators, for example of the interlocking type (not shown in the figures), which allow stable positioning in the closed configuration with respect to the plate 110 and optionally to vary the inclination.

In order to allow adjustability of the plate 110 with respect to the dimensions of the shoe 111, the plate is divided into two aligned portions 110*a* and 110*b*: the first portion has a tab 136 with a slotted hole 137 which lies on the second portion at a corresponding slotted hole which is not shown in the figures.

A bolt 138 or an equivalent coupling system, by passing through the slotted holes, locks the two portions 110*a* and 110*b* of the plate 110 in the intended mutual position.

It should also be noted that in the same manner it is possible to allow the plate 110 to widen.

The same solution is used to join the half-rings 133 to the respective openable wings 131.

Each one of the half-rings 133 in fact has a tab 139 which is superimposed on a corresponding portion of the wing 131, while a bolt 140 passes through the two corresponding slotted holes so as to fix the parts to each other; only the hole 141 is shown.

In practice, it has been observed that the above-described skate, in both of its embodiments, has achieved the intended aim and objects of the present invention.

As mentioned, the skate in fact has a wheel configuration which is per se more suitable than others to handle turns and which, when tilted, actually causes the wheels to determine a curved path.

As mentioned above, this effect can be compared to the effect caused by the particular shape of the sides of skis, known as sidecut.

This effect can be adjusted (customized) as a function of the profile, thickness and material that constitutes the wheels and of the elastic response of the pads.

The elastic coupling also provides a cushioning effect which absorbs stresses.

The invention thus conceived is susceptible of numerous modifications and variations, all of which are within the scope of the appended claims.

All the details may also be replaced with other technically equivalent elements.

In practice, the materials employed, so long as they are compatible with the contingent use, as well as the dimensions, may be any according to requirements.

What is claimed is:

1. Skates having a supporting structure to which chassis supports are connected to retain a plurality of in-line wheels, each comprising:

at least two chassis support which are each directly coupled to the supporting structure that is joined to a sole portion of a boot of the skate, wherein the chassis supports are each coupled to the supporting structure at two connection points, wherein the first connection point to the chassis support is coupled to the front of the sole portion of the boot and the second connection point to the chassis support is coupled to the rear of the sole portion of the boot, each chassis support retaining at least two wheels and being coupled to the supporting structure so that the wheels of the first chassis support are alternated in an in-line arrangement with the wheels retained by the second chassis support, allowing the first chassis support to retain the first and third wheels and the second chassis support to retain the second and fourth wheels from the front of the skate.

2. The skates according to claim 1, wherein said coupling of at least one of said supports to said supporting structure that allows changes in the level of at least one of the respective rotation axes of the wheels is an elastic coupling.

3. The skates according to claim 1, wherein at least one of said supports is coupled to the supporting structure with a hinge having a horizontal axis.

4. The skates according to claim 2, wherein at least one of said wheels has a different sectional profile with respect to the others.

5. The skates according to claim 4, wherein said at least one wheel that has a different sectional profile with respect to the others is one of the central wheels.

6. The skates according to claim 4, wherein the end wheels are at a higher level than the others from the ground when there is no load on them.

7. The skates according to claim 4, wherein said at least one wheel that has a different sectional profile with respect to the others also has a smaller diameter than the others.

8. The skates according to claim 1, wherein said supports have a longitudinal channel wherein the channel has a concave shape extending from the center wheel axle to the end wheel axle and said supporting structure is coupled to said support so as to allow oscillating movements thereof.

9. The skates according to claim 1, wherein said two wheel supports are fixed to said structure with respective elastomeric pads interposed.

10. The skates according to claim 8, wherein said supports are connected by elastic coupling means.

11. The skates according to claim 10, characterized in that said elastic coupling means have an adjustable elastic response.

12. The skates according to claim 1, wherein screws are driven into suitable holes of the supporting structure and constitute adjustable stroke limiters for the movements of said supports.

13. The skates according to claim 1, wherein said supports rest laterally on axles that retain the wheels to the supports.

14. The skates according to claim 1, wherein said supporting structure is disconnectable from a shoe.

15. The skates according to claim 1, wherein said supporting structure can be lengthened and widened.

16. The skates according to claim 1, wherein said supporting structure contains elements for coupling to the shoe.

17. The skates according to claim 1, wherein two wings are articulated to said supporting structure at the cuff of the shoe, said wings ending in an upward region with respective half-rings which are suitable to surround the cuff.

18. The skates according to claim 17, wherein said wings can rotate about the respective horizontal axes and are rigidly coupled to each other so as to lie between an open configuration for disengaging the cuff and a closed configuration for surrounding and locking said cuff.

19. The skates according to claim 17, wherein said wings are rigidly coupled to each other with a closure device.

20. The skates according to claim 17, wherein said wings are extendable.

* * * * *